US005570939A

United States Patent [19]

Scott

[11] Patent Number: 5,570,939

[45] Date of Patent: Nov. 5, 1996

[54] COUNTERTOP FOR FUME HOOD OR SIMILAR APPLICATIONS

[75] Inventor: Van G. Scott, Knoxville, Tenn.

[73] Assignee: Smokey Mountain Tops, Inc., Knoxville, Tenn.

[21] Appl. No.: 433,139

[22] Filed: May 3, 1995

[51] Int. Cl.[6] ..... A47B 77/06

[52] U.S. Cl. ..... 312/229; 312/228; 312/232; 312/140.3; 312/140.4; 108/24; 454/56

[58] Field of Search ..... 312/228, 232, 312/140.3, 140.4, 229; 108/24; 454/56 X

[56] References Cited

U.S. PATENT DOCUMENTS

| | | | |
|---|---|---|---|
| 214,271 | 4/1879 | Zundorff | 108/24 |
| D. 306,100 | 2/1990 | Wende | 108/24 X |
| D. 314,104 | 1/1991 | Johnson | 467/469 |
| 2,539,462 | 1/1951 | Norquist | 312/140.3 X |
| 2,702,505 | 2/1955 | Nelson | 98/115 |
| 3,041,957 | 7/1962 | Liptay | 98/115 |
| 3,231,903 | 2/1966 | Cope | 312/228 X |
| 3,747,505 | 7/1973 | Turko | 98/115 |
| 3,956,977 | 5/1976 | Turko et al. | 98/115 |
| 4,142,458 | 3/1979 | Duym | 98/115 |
| 4,327,274 | 4/1982 | White et al. | 219/198 |
| 4,502,375 | 3/1985 | Hignite et al. | 98/115 |
| 4,606,576 | 8/1986 | Jones | 108/24 X |
| 4,774,878 | 10/1988 | Berlin et al. | 98/115 |
| 4,934,280 | 6/1990 | Bae | 108/25 X |
| 5,085,134 | 2/1992 | Hofstra et al. | 454/67 |
| 5,181,883 | 1/1993 | Hofstra et al. | 454/49 |
| 5,216,782 | 6/1993 | Schenck et al. | 454/56 X |
| 5,240,138 | 8/1993 | Gallagher | 220/658 |
| 5,413,035 | 5/1995 | Fernandez | 108/24 X |
| 5,444,470 | 8/1995 | Muto et al. | 347/15 |

FOREIGN PATENT DOCUMENTS

| | | | |
|---|---|---|---|
| 0486971A1 | 11/1991 | European Pat. Off. . | |
| 3624090 | 7/1987 | Germany | 312/228 |
| 2112129 | 7/1983 | United Kingdom | 454/56 |
| 2236667 | 4/1991 | United Kingdom | 312/140.3 |

*Primary Examiner*—Peter M. Cuomo
*Assistant Examiner*—Stephen Vu
*Attorney, Agent, or Firm*—Paul E. Hodges

[57] ABSTRACT

A countertop for use in a fume hood or similar application including a substantially planar member which defines the countertop and a recess defined in the top surface of the countertop and which defines a reservoir for liquid spills. Within the recess there is provided a platform having a top surface that is disposed at a lower level than the level of the top surface of the countertop, but at a higher level than the bottom surface of the recess. A cupsink is provided on the platform. Preferably a safety zone demarcation identifier is provided which is mounted in a groove formed in the countertop. Both the countertop and the indentifier preferably are formed of an acrylic resin.

7 Claims, 3 Drawing Sheets

COUNTERTOP FOR FUME HOOD OR SIMILAR APPLICATIONS

TECHNICAL FIELD

This invention relates to the field of fume hoods and particularly to an improved countertop used in a fume hood.

BACKGROUND ART

Fume hoods are well recognized in the art as providing a protective environment in which hazardous materials may be safely handled, particularly where the hazardous material is in a liquid or gaseous form. These hoods are designed to capture and pull or direct fumes safely away from a person or equipment which is with or associated with the hazardous material. A fume hood of the prior art is shown in U.S. Pat. No. 2,702,505, issued to Laurence N. Nelson, on Feb. 22, 1955. Inside the fume hood is a countertop which provides a working surface on which there may be placed various items such as containers of various materials and equipment. A typical countertop is seen in Nelson FIG. 1 at 2. It is such a countertop to which the present invention is directed.

Fume hood countertops typically have a uniform, level surface that is recessed in the central top portion thereof to define a type of reservoir to contain spills of liquids and the like. These reservoirs in the prior art countertops are necessarily shallow and poorly designed for ensuring the desired capture of spills. The shallowness of these prior art reserviors is due to the relative thinness of the countertop which is desirable to reduce the weight and cost of the countertop. Currently countertops for fume hoods are manufactured from slabs of epoxy resin. This material is relatively inert to most chemicals, but is relatively easily scarred, scratched or discolored and is not easily worked by common cutting tools. The nature of the epoxy resin is such that repair of spot damage to the countertop is not often practiced in that the epoxy resin cannot be sanded or buffed to a sufficiently smooth surface using the usual field maintenance tools and methods. Thus, the prior art epoxy resin countertops most often must be replaced when they suffer only spot damage, hence the need to minimize the cost of the countertop by making it as thin as practicable, hence the use of shallow reserviors which are less than suitable for containing spills and providing the desired protection of a person using the hood and the environment ambient to the exterior of the hood.

A typical feature of a fume hood countertop is a cupsink. A cupsink generally comprises an opening through the thickness of a countertop which receives therein a type of flanged cup. The cup may have a closed bottom in which case it serves to contain liquids or solids placed therein. Or, the cup may have a discharge opening in its bottom, this discharge opening being connected to a pipe, hose or the like that leads to a larger receptacle or to the sewer. Typically the cupsink is small and positioned in one or more of the corners of the countertop.

As noted above, typically prior art fume hood countertops are made of an epoxy resin. While this is useful in that the countertops are long-lived, durable, and non-reactive to most chemicals that spill on the surface of the countertop, the epoxy resins are not easily machineable, sandable, or field workable. Such epoxy resins are also easily scratched. They are discolored by certain chemicls, and the discoloration remains even after cleaning.

Finally, the prior art epoxy resins used in the manufacture of fume hood countertops are dark-colored. Often, it is advantageous to the user to have a white or light-colored background against which to conduct their activities within the hood.

The typical prior art fume hood countertop also employs sharp (e.g. 90°) angles at the juncture of the sidewalls of the reservoir thereof and the bottom of the reservoir, and the top surface of the countertop. Effective cleaning in the crevices created by such angles is at the best difficult and time-consuming, and at the worst is not possible.

Certain regulatory agencies require fume hood countertops to have a safety zone demarcation line clearly defined on the countertop near the front opening to the fume hood and extending between the opposite sides of the fume hood. The placement of this safety line is such as to define the permissible working area of the countertop interiorly of the fume hood and within which the air flow from outside the hood and into and out the exhaust of the hood, is effective to prevent fumes from escaping out the front opening of the hood. No material is to be placed forwardly of this safety line. Typically, these lines are merely painted on or comprise a colored tape which is adhered to the countertop. Thus, after short terms of use, the line is abraded away by reason of the movement of materials and equipment thereacross during loading of the hood, and by reason of abrasive cleanings. Painted lines and tapes are less resistant to corrosive environments than is the epoxy resin countertop so that over time the prior art type of lines tend to fade or become indistinguishable from the countertop itself.

Therefore, it is an object of this invention to provide an improved countertop for a fume hood or like enclosure that reduces the likelihood that a liquid spill within the hood will escape the hood.

Another object of the present invention is to provide a countertop for a fume hood or like enclosure wherein the countertop includes a novel and improved safety zone demarcation identifier.

Other objects and advantages of the present invention will be recognized from the description provided herein including the claims and the drawings in which:

SUMMARY OF THE INVENTION

In accordance with the present invention there is provided an improved countertop for use in a fume hood or similar application. The improved countertop includes a substantially planar member which defines the interior floor for the fume hood. A recess is defined in the top surface of the planar member, the recess extending substantially between the outer boundaries of the planar member and defining a working surface having a raised rim about the perimeter of the recess to thereby define a reservoir that is capable of receiving and containing a liquid that might be spilled into the reservoir during use of the hood.

With respect to one aspect of the invention, there is provided at least one raised platform disposed within the reservoir. The top surface of the platform is at a level which is lower than the level of the top surface of the planar member so that the flow of liquid which is spilled into the reservoir and which is in excess of the volume of the reservoir, is facilitated onto the top surface of the platform. A cupsink is provided in association with the top surface of the platform so that liquid flowing onto the platform is directed into the cupsink for transfer out of the hood in a safe manner.

Another aspect of the present invention includes a safety zone demarcation identifier which is embedded in or formed integrally with the top surface of the planar member. Preferably this identifier is formed from the same material as the planar member, but is colored or otherwise made visually distinctive from the top surface of the planar member. In a preferred embodiment, the planar member is formed from an acrylic resin material. Also, preferably the safety zone demarcation identifier is formed from the same or a compatible acrylic resin so that these two components exhibit like physical characteristics, especially their amenability to being worked in the field as for repair or modification for a particular application of the countertop. Similarly, use of the same or compatible acrylic resins for these two components of the countertop provides the same type of resistance to chemical damage. Still further, the embedded identifier may be periodically renewed with relative ease using common field maintenance tools and techniques.

DETAILED DESCRIPTION OF INVENTION

Figure 1:
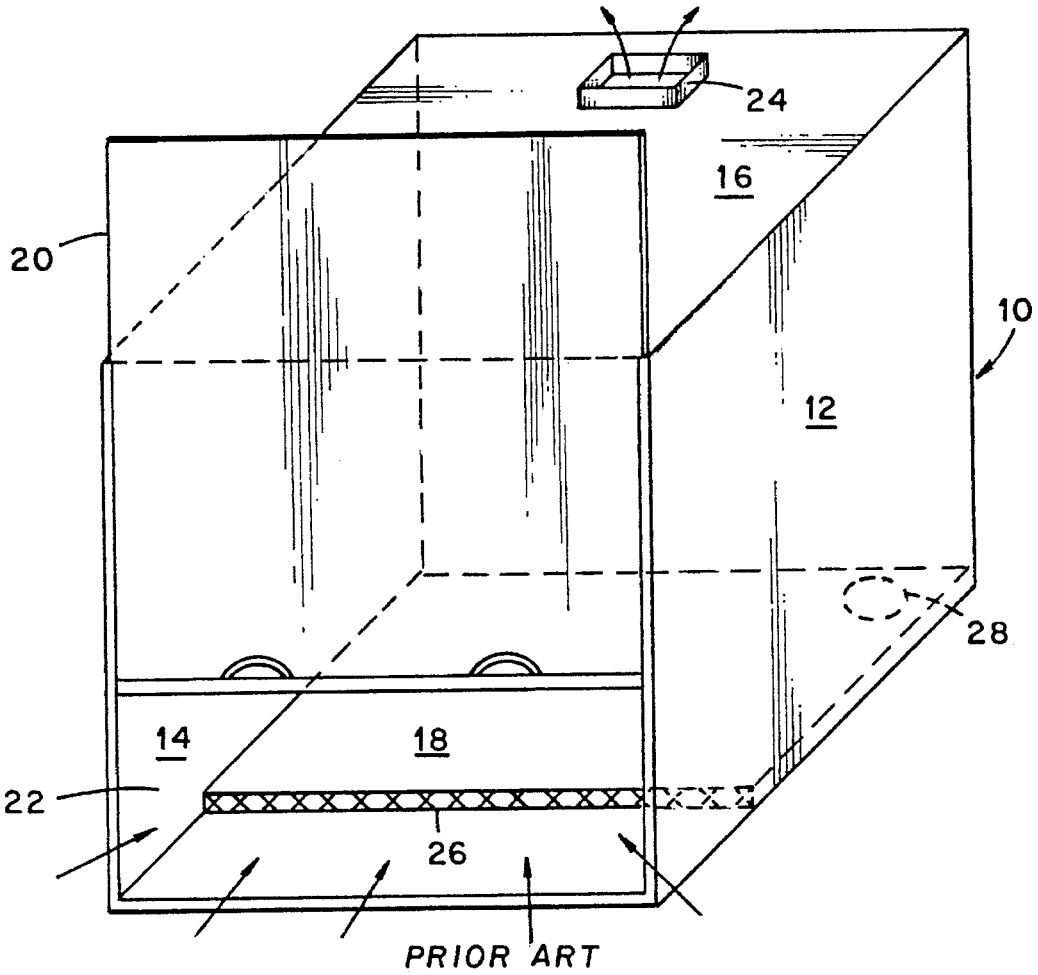
FIG. 1 is a representation of a prior art fume hood and embodying various of the features of the present invention.

With reference to FIG. 1, a typical fume hood 10 comprises an enclosure defined by opposite side walls 12 and 14, a top 16 and a floor 18. As used herein, the terms "floor" and "countertop" are used interchangeably unless otherwise indicated. It is to be recognized, however, that a fume hood may have a bottom which could be considered a floor and that a countertop in accordance with the present invention could be placed inside the fume hood and resting on a floor of the hood. A typical fume hood further includes a transparent front door 20 which most commonly comprises a vertical panel that is slidably mounted between the front edges of the side walls of the enclosure. Vertical positioning of the panel establishes a front opening, indicated generally by the numeral 22, near the floor of the enclosure and through which ambient air flows into the interior of the enclosure. This inflowing air mixes with fumes within the enclosure and is drawn out from the enclosure through an exhaust opening 24 by means well known in the art.

A typical fume hood further includes a safety zone demarcation line 26 on the upper surface of the floor 18 and extending between the opposite side walls of the fume hood. As noted hereinbefore, this safety line serves to define for a user of the hood, that area of the floor of the hood which is considered safe for placing a fume-generating entity such that the fumes emanating therefrom will be properly entrained in the incoming air stream and carried out of the hood through the exhaust opening.

A through opening defining a cupsink 28 is commonly provided in a typical fume hood.

Figure 2:
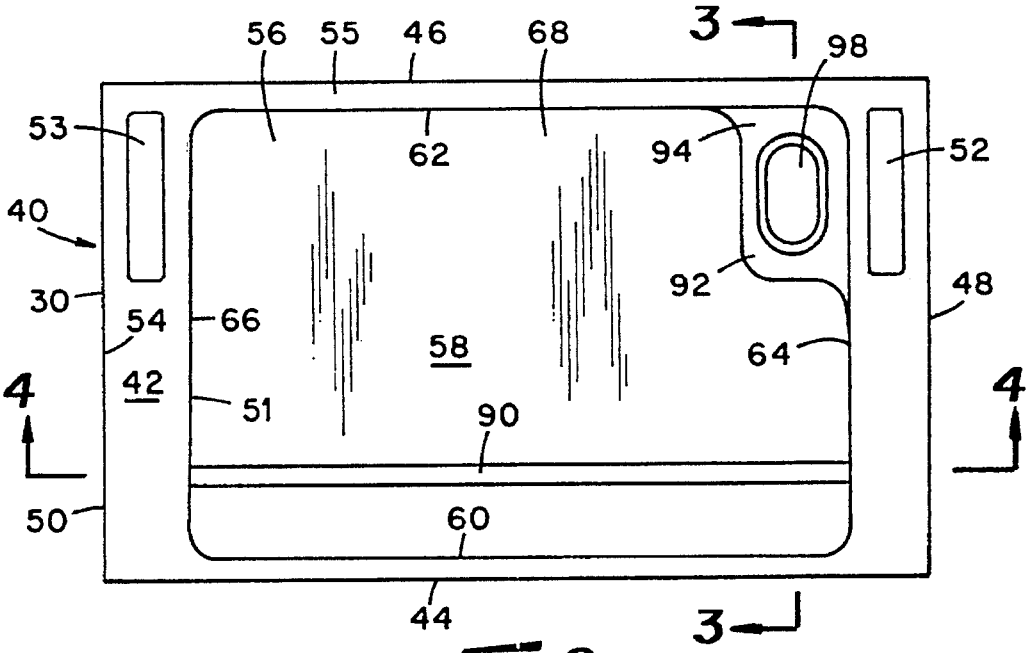
FIG. 2 is a top view of a countertop for a fume hood and embodying various of the features of the present invention.

In accordance with the present invention, and with reference to FIG. 2, there is depicted an improved countertop 30 which defines the work-supporting surface of a fume hood. The depicted countertop is contoured and sized to be received within a fume hood and define the floor thereof. Most commonly, the countertop is rectangular in geometry and of a thickness of less than about one and one/half to two inches. Because a countertop of a fume hood is subject to relatively harsh abrasive and/or corrosive treatment during use of the hood, and therefore in the prior art required replacement often, the thickness of the countertop was kept to a minimum to minimize the overall cost of the countertop. Further, minimum thickness of the countertop is desirable to minimize the weight of the countertop. This minimum thickness goal, however, dictates against any modification of the top (working) surface of the countertop which would tend to reduce the thickness of the countertop to a value which would adversely weaken the countertop and subject it to damage by the placement thereon of heavy equipment such as a vacuum pump, for example. The present inventor has found that through the use of an acrylic resin-based material as the material of construction of the countertop, one can realize the benefits of a minimized volume countertop of acceptably low overall weight and strength, and further provide additional beneficial features in the countertop.

More specifically, the countertop of the present invention, includes a substantially planar member 40 having a top surface 42, a front edge 44, a rear edge 46, and opposite side walls 48 and 50. As shown in FIG. 1, the member 40 may include one or more openings 52 and 53 which extend through the thickness thereof to provide access ports for electrical wiring, plumbing or the like. With reference to FIGS. 2–5, the present countertop is further provided with a depression 56 in the top surface 42 thereof. This depression extends over a major portion of the area of the top surface 42 of the countertop between the front edge 44, the rear edge 46 and the opposite side walls 48 and 50. Importantly, the depression is dimensioned such that its perimeter 51 is at all points spaced inwardly of the outer perimeter 54 of the countertop itself, thereby defining a flat rim portion 55 of the top surface 42 that extends around the perimeter of the depression.

As depicted, the depression 56 includes a bottom 58 which provides a flat working surface, a front wall 60, a rear wall 62 and opposite side walls 64 and 66, thereby defining a reservoir 68 for receiving and containing one or more liquids, such as a liquid which may be inadvertently spilled while within the fume hood.

Figure 3:
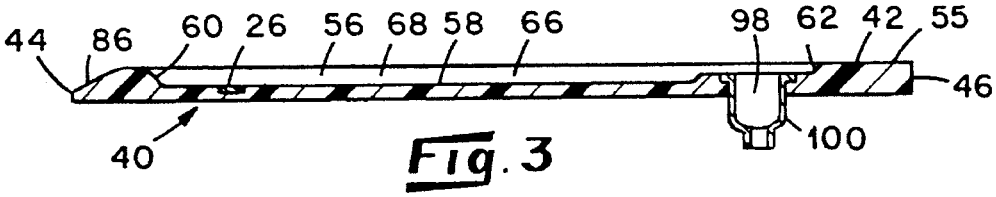
FIG. 3 is a sectional view taken generally along the line 3—3 of FIG. 1.
Figure 4:
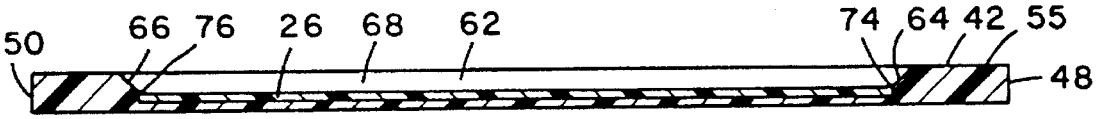
FIG. 4 is a sectional view taken generally along the line 4—4 of FIG. 1.
Figure 5:
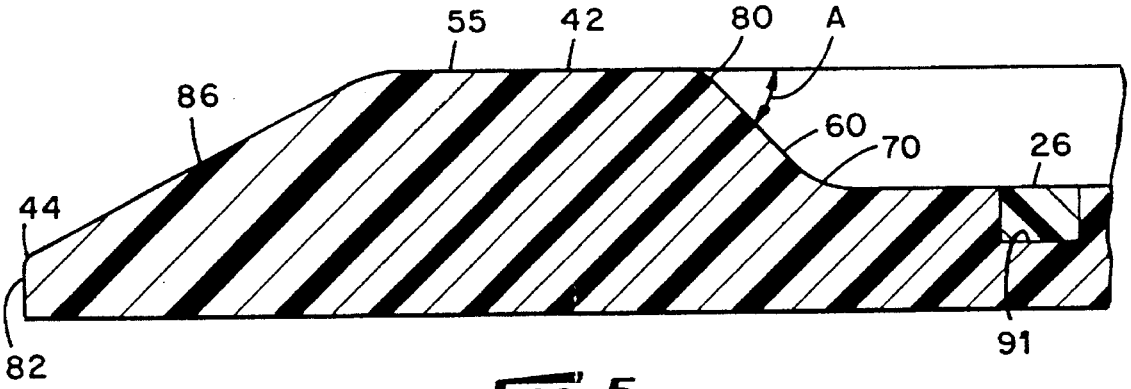
FIG. 5 is an enlarged view of a portion of the left hand end of the countertop as depicted in FIG. 3.
Figure 6:
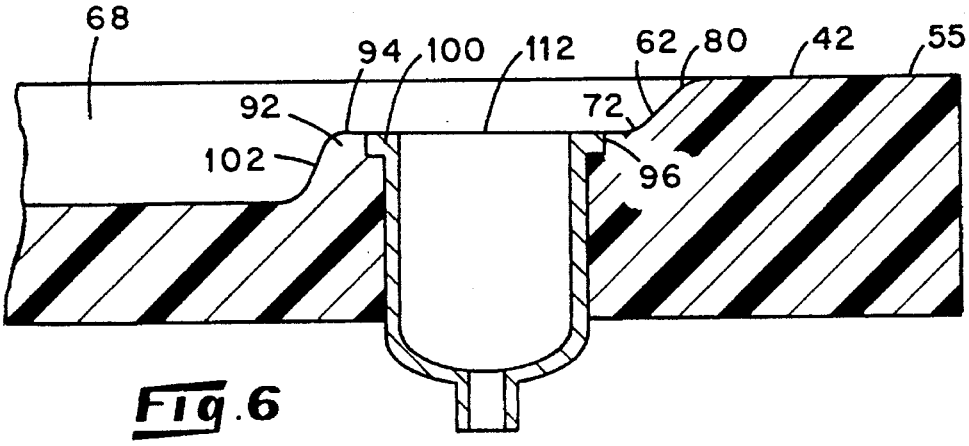
FIG. 6 is an enlarged view of a portion of the right hand end of the countertop as depicted in FIG. 3.
Figure 7:
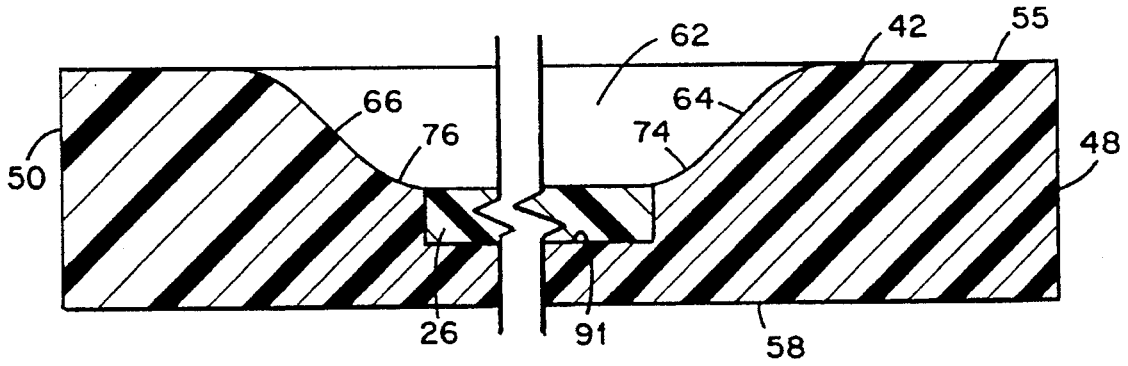
FIG. 7 is an enlarged view of the opposite ends portions of the sectional view of the countertop depicted in FIG. 4.

As best seen in FIGS. 3–5, the juncture 70 of the front wall 60 of the depression 56 with the bottom 58 of the depression is radiussed. In like manner, the juncture 72 of the rear wall 62 of the depression with the bottom of the depression is also radiussed. Still further, the junctures 74 and 76 between the side walls 64 and 66, respectively, of the depression with the bottom of the depression are also radiussed. The radius at each juncture may vary, depending in part upon the depth of the depression, i.e. the vertical distance from the top surface 42 to the bottom 58 of the depression. In a typical countertop of the present invention which has a thickness of about one inch and including a depression having a depth of about one/half inch, the preferred radius of each of the junctures 70,72,74 and 76 is about 0.5 inch thereby providing a substantially rounded surface at each such juncture. These radiussed junctures have been found to provide at least two advantages not known to have been available in the prior art. First, the radiussed junctures are readily and easily cleaned without leaving residual matter trapped therein. Second, and importantly, the radiussed junctures have been found to serve as flow control areas in the event there occurs a liquid spill within the depression and liquid from the spill tends to flow laterally within the depression. That is, when the flowing liquid reaches a juncture, its direction is gradually directed upwardly, as opposed to the flowing liquid engaging a vertical wall and tending to splash out of the depression. This control over the lateral flow of a spilled liquid is further enhanced in accordance with the present invention by inclining each of the front, rear and side walls of the depression at an angle with respect to the top surface 42 of the countertop such that the walls of the depression slant downwardly from the top surface and inwardly of the depression. By this means, the lateral flow of a spilled liquid is stemmed by reason of the liquid having to flow "uphill" at each juncture. In a preferred embodiment, the downward and inward angle of slant of each wall of the depression relative to the top surface is chosen to be about forty-five degrees as indicated by the arrow "A" of FIG. 5.

In a preferred embodiment, the inward edge 80 of the rim 55 is also radiussed, employing a radius of about 0.125 inch in the depicted embodiment, to also facilitate cleaning. This radius of the rim further serves to reduce chipping of the rim when moving equipment in and out of the fume hood, among other purposes.

Also as depicted in FIGS. 3 and 5, the area of the front edge 44 of the countertop of the present invention is contoured to enhance the flow of air entering the front opening 22 of the fume hood. Referring specifically to FIG. 5, in the depicted embodiment, the leading edge 82 of the front edge 44 of the countertop is of reduced thickness so that there is provided an upwardly inclined short surface portion 86 that extends from the front edge 44 of the countertop and between the opposite side walls of the fume hood inwardly of the fume hood, thereby reducing the resistance to the flow of air into the front opening of the fume hood. Further, the juncture 88 of the surface portion 86 with the top surface 42 and which extends along the length dimension of the front edge 44 is radiussed to further enhance the flow of incoming air. Additionally, the inclined surface portion 86 is not suitable to receive liquid containers, etc. thereon and thereby serves as a further safety feature of preventing the placement of containers, etc. forwardly of the safety zone.

Figure 8:
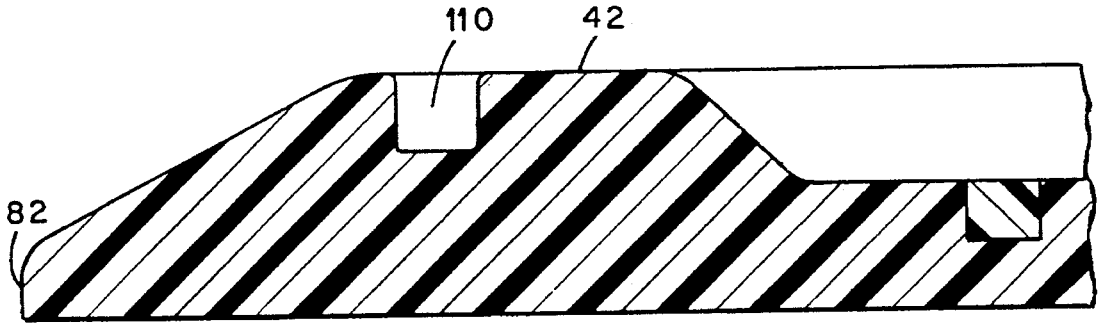
FIG. 8 is an enlarged view as in FIG. 5, and depicting an alternative embodiement that includes a secondary liquid spill capture trough.

In one alternative embodiment of the countertop of the present invention, as depicted in FIG. 8, the present inventor provides an elongated over-flow trough 110 that is located in the top surface 42 of the leading edge 82 of the countertop. This trough preferably has closed opposite ends, and extends lengthwise between the opposite side walls 48 and 50 of the countertop. This trough thus defines a secondary capture area for liquid spilled within the depression 56 and which overflows from the depression in the direction of the open front of the hood (i.e. toward an operator standing in front of the hood).

Contrary to the prior art methods and techniques for identifying the permissible working zone within a fume hood using a painted line or tape strip applied to the surface of the countertop, the present inventor has discovered that the safety zone demarcation may more identifiably and permanently be provided by means of a area of visually distinctive material embedded within and permanently secured to, e.g. integrally formed with, the countertop and defining a safety zone demarcation identifier 90. In a preferred embodiment, this material is of the same acrylic-based material as used in the construction of the countertop itself, but of a visually distinctive appearance relative to the remainder of the countertop. The area of visually distinctive material may comprise an elongated strip-type area which extends between the side walls of the depression 56, or alternatively it may cover a much more extensive portion of the countertop, such as extending from the most inwardly limit of the safety zone outwardly toward, or even to, the front edge of the countertop, and between the side walls 48 and 50 of the countertop. This area of visually distinctive material may be made visually distinctive by any suitable means, but most preferably by choosing a color therefor which contrasts with the color of the remainder of the countertop. Alternatively, the area of visually distinctive material may comprise a plurality of parallel strips of visually distinctive material each of which extends from the most inwardly limit of the safety zone and outwardly toward, or to, the front edge of the countertop. As desired, these strips may be disposed at an angle to the front-to-rear direction of the countertop, such as the recognized alternating yellow and black stripes of a danger zone.

In any event, in the preferred embodiment, the safety zone demarcation identifier 90 is embedded in a groove 91 provided in the top surface of the bottom of the depression 56, or as appropriate, in the top surface of the countertop. Also preferably, the thickness of the identifier is chosen to permit the countertop, following damage thereto, to be repaired by conventional means such as sanding or machining away a portion of the top surface of the countertop without thereby removing or destroying the identifier. In fact, such repair of the countertop actually renews the quality of the identifier by exposing a "fresh" top surface thereof. As desired, even though the body portion of the countertop does not require repair, the prominence of the safety zone identifier may be routinely enhanced by a simple sanding procedure. An acceptable thickness of the identifier is about one half of the overall thickness of the countertop.

In accordance with another aspect of the present invention, the countertop is provided with at least one platform 92 having a top surface 94 and being disposed within the depression, preferably in or near one corner thereof. An opening extends from the top surface 94 of the platform through the thickness of the countertop to define a cupsink 98. Notably, the vertical level of the top surface 94 of the platform preferably is disposed at a level below the level of the top surface 42 of the countertop. By this means, any liquid which is spilled into the reservoir 68 and which is of a volume which either exceeds the maximum volume of the reservoir or which is of a volume which at least causes the level of the liquid within the reservoir to rise above the level of the top surface 94 of the platform 92, will overflow first onto the platform 92. Thereupon, the overflowing liquid may pass into or through a cup 100 which is disposed in an appropriae perimetrical recess 96 in the top edge of the cupsink, thereby preventing overflow of the liquid out of the reservoir at other locations such as at the front of the hood. As described hereinabove with respect to the contoured relationship of the walls of the depression with the top surface of the countertop, the wall(s) 102 of the platform are like contoured for like purposes. Because of the elevated nature of the top surface of the platform with respect to the bottom of the depression, smaller quantities of liquid spilled and collected within the reservoir defined by the depression cannot escape from the fume hood via the cupsink, assuming the volume of the liquid is less than the volume of the depression which, as noted, is most common considering the maximization of the volume of the depression that is provided by the present invention. On the other hand, because the open mouth 112 of the cup 100 is flush with the top surface 94 of the platform 92, any liquid which overflows from the depression onto the top of the platform will flow out through the cupsink and will not overflow the depression and onto the top surface 42 of the countertop.

Herein the location of the platform 92 within the depression 56 is described and depicted in the Figures as being located in one corner of the depression. This is a preferred location for the platform, but it will be recognized that the platform may be located in another position within the depression as desired. Further, as desired, more than one platform and accompanying cupsink may be employed. Still further, the area of the top surface 94 of the platform is limited to at least that area which is sufficient to receive the cup 100, but its maximum area is a matter of design choice.

Whereas the present invention has been described as a countertop for fume hoods, it is to be recognized that the disclosed countertop may be used in other applications such as a countertop for a laboratory bench, or it could be used with other types of hoods or cabinets such as laminar flow cabinets as may be found in clinical laboratories or the like, or in biological safety cabinets. Further, the claimed countertop may be of any color desired.

Whereas the present invention has been described in specific terms for disclosure purposes, it is intended that the invention be limited only by the claims appended hereto.

What is claimed:

1. An improved countertop for use in a corrosive or abrasive environment a substantially planar member having a top surface, a bottom surface, a front edge, a rear edge and opposite side edges, a recess defined in said top surface of said substantially planar member, said recess extending substantially between said front edge and said rear edge of said substantially planar member, and between said opposite side edges of said substantially planar member, to define a substantially flat working surface area that extends over at least a major portion of said substantially planar member, said recess including front, rear and opposite side walls that extend from said working surface to said top surface of said substantially planar member to define a perimeter of said working surface area, each of said front, rear and opposite side walls of said recess defining a radiussed juncture with said working surface area and with said top surface of said planar member, thereby defining a reservoir for containing one or more liquids therein, and at least one platform disposed within said recess, said platform including a top surface that is disposed at a level higher than the level of said working surface area of said recess and lower than the level of said top surface of said substantially planar member and including means defining an opening that extends from the top surface of said platform fully through the thickness of said substantially planar member to define a cupsink.

2. The improvement of claim 1 and including means defining a safety zone demarcation indicator.

3. The improvement of claim 2 wherein said safety zone demarcation indicator comprises a visually distinctive material embedded within the thickness of said substantially planar member.

4. The improvement of claim 1 wherein said substantially planar member comprises an acrylic resin material.

5. The improvement of claim 3 wherein each of said substantially planar member and said safety zone demarcation identifier comprises an acrylic resin material.

6. In a countertop for a fume hood or enclosure which includes a front opening through which ambient air enters the fume hood to mix with fumes within the interior of the fume hood and an exhaust opening through which ambient air entering the fume hood and admixed with the fumes, is exhausted, the improvement comprising in combination a substantially planar member defining a floor of the fume hood and having a top surface, a front edge, a rear edge and opposite side edges, a recess defined in said top surface of said substantially planar member, said recess extending substantially between said front edge and said rear edge of said floor, and between said opposite side edges of said floor, to define a working surface area that extends over a major portion of said floor of the fume hood and including front, rear and opposite side walls that extend from said floor to said top surface of said substantially planar member to define a perimeter of said working surface area, each of said front, rear and opposite side walls of said recess defining a radiussed juncture with said working surface area and with said top surface of said planar member, thereby defining a reservoir for containing one or more liquids therein, and a platform disposed in the region of at least one corner of said recess, said platform including a top surface that is disposed at a level lower than the level of said top surface of said substantially planar member and including means defining an opening that extends from the top surface of said platform fully through the thickness of said substantially planar member to define a cupsink.

7. In a countertop for a fume hood which includes a front opening through which ambient air enters the fume hood to mix with fumes within the interior of the fume hood and an exhaust opening through which ambient air entering the fume hood and admixed with the fumes, is exhausted, the improvement comprising in combination a substantially planar member formed of an acrylic resin material which is readily altered or repaired using field maintenance tools and techniques, said substantially planar member defining a floor of the fume hood and having a top surface, a front edge, a rear edge and opposite side edges, a recess defined in said top surface of said substantially planar member, said recess extending substantially between said front edge and said rear edge of said floor, and between said opposite side edges of said floor, to define a working surface area that extends over a major portion of said floor of the fume hood and including front, rear and opposite side walls that extend from said floor to said top surface of said substantially planar member to define a perimeter of said working surface area, each of said front, rear and opposite side walls defining a radiussed juncture with said working surface area and with said top surface of said planar member, thereby defining a reservoir for containing one or more liquids therein, and at least one platform disposed within said recess, said platform including a top surface that is disposed at a level higher than the level of said working surface area of said recess and lower than the level of said top surface of said substantially planar member and including means defining an opening that extends from the top surface of said platform fully through the thickness of said substantially planar member to define a cupsink, and wherein the difference in the levels of said top surface of said substantially planar member and the top surface of said platform facilitates the flow of liquid overflowing said reservoir onto said platform and in position to flow from said recess through said cupsink a safety zone demarcation identifier comprising an acrylic resin material which is compatible with the acrylic resin material of said substantially planar member, said indentifier being embedded within said top surface of said countertop and visually distinctive therefrom.

* * * * *

UNITED STATES PATENT AND TRADEMARK OFFICE

CERTIFICATE OF CORRECTION

PATENT NO. : 5,570,939

DATED : November 5, 1996

INVENTOR(S) : Van G. Scott

It is certified that error appears in the above-indentified patent and that said Letters Patent is hereby corrected as shown below:

Column 1, line 17 after "is" insert --working--

Signed and Sealed this

Eighteenth Day of February, 1997

*Attest:*

*Attesting Officer*

Bruce Lehman

BRUCE LEHMAN

*Commissioner of Patents and Trademarks*